US006471329B1

(12) United States Patent
Maza

(10) Patent No.: US 6,471,329 B1
(45) **Date of Patent: *Oct. 29, 2002**

(54) INKJET PRINTHEAD CAPPING METHOD AND APPARATUS

(75) Inventor: Jesus Garcia Maza, Sant Cugat del Valles (ES)

(73) Assignee: Hewlett-Packard Company, Palo Alto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 43 days.

(21) Appl. No.: 09/032,386

(22) Filed: Feb. 26, 1998

Related U.S. Application Data

(63) Continuation-in-part of application No. 08/811,552, filed on Mar. 4, 1997, now Pat. No. 6,042,216.

(51) Int. Cl.[7] ..... B41J 2/165
(52) U.S. Cl. ..... 347/29; 347/32
(58) Field of Search ..... 347/29, 30, 33, 347/49, 36, 86, 87, 24, 22, 32

(56) References Cited

U.S. PATENT DOCUMENTS 5,455,609 A * 10/1995 Gast et al. ..... 347/32
5,638,099 A * 6/1997 Nguyen et al. ..... 347/22
5,745,133 A * 4/1998 Hendricks et al. ..... 347/33
5,812,157 A * 9/1998 Nguyen et al. ..... 347/32
5,936,647 A * 8/1999 Rhodes et al. ..... 347/29
6,042,216 A * 3/2000 Garcia et al. ..... 347/29
6,106,098 A * 8/2000 Nakamura et al. ..... 347/30

FOREIGN PATENT DOCUMENTS

GB 2 284 576 A * 6/1995 ..... 347/30
JP 406079875 * 3/1994 ..... 347/29
JP 406191052 * 7/1994 ..... 347/29

* cited by examiner

*Primary Examiner*—David F. Yockey
*Assistant Examiner*—Shih-Wen Hsieh

(57) ABSTRACT

An improved capping method and apparatus is provided for capping a plurality of inkjet printer cartridges. A plurality of capping device are mounted on a common support member which is biased towards the respective printheads of a plurality of cartridges. Relative movement in the capping direction between the capping device and the printheads is limited by a mechanical stop and the biasing force provided is sufficiently large to ensure that in use this relative movement is always so limited. By providing a substantially constant displacement in the capping direction between a set of cartridges and a set of capping means, the capping force between a particular printhead and its respective capping device dependent only on the manufacturing tolerances associated with the particular printhead and capping device and not those associated with all other printheads and capping device in the set.

12 Claims, 17 Drawing Sheets

INKJET PRINTHEAD CAPPING METHOD AND APPARATUS

CROSS-REFERENCE TO RELATED APPLICATIONS

This application is a continuation-in-part of Ser. No. 08/811,552 filed Mar. 4, 1997, now U.S. Pat. No. 6,042,216.

The present application is related to the following co-pending commonly assigned applications, all of which are incorporated herein by reference: U.S. Ser. No. 08/811,405 filed Mar. 4, 1997 by Brian Canfield et al entitled MANUALLY REPLACEABLE PRINTHEAD SERVICING MODULE FOR EACH DIFFERENT INKJET PRINTHEAD, U.S. Ser. No. 08/810,485 by Rick Becker et al, filed on Mar. 3, 1997 entitled INKJET PRINTING WITH REPLACEABLE SET OF INK-RELATED COMPONENTS (PRINTHEAD/SERVICE MODULE/INK SUPPLY) FOR EACH COLOR OF INK, U.S. Ser. No. 08/923,213 entitled A STORAGE CONTAINER FOR INKJET CARTRIDGES HAVING REMOVABLE CAPPING MEANS AND A METHOD FOR STORING INKJET CARTRIDGES filed Sep. 3, 1997 by Jordi Bartolome et al, Atty Docket 60960017 entitled METHOD AND APPARATUS FOR LOCATING AN INKJET PRINTER CARRIAGE RELATIVE TO A SERVICE STATION filed Feb. 26, 1998 by Jesus Garcia Maza et.

FIELD OF THE INVENTION

The present invention relates to the capping of printheads of inkjet cartridges used in inkjet printers, and in particular to an improved method and apparatus for capping a plurality of cartridges.

BACKGROUND TO INVENTION

Inkjet cartridges are now well known in the art and generally comprise a body containing an ink supply and having electrically conductive interconnect pads thereon and a printhead for ejecting ink through numerous nozzles in a printhead. In thermally activated inkjet cartridges, each cartridge has heater circuits and resistors which are energised via electrical signals sent through the interconnect pads on the cartridge. Each inkjet printer can have a plurality, often four, of cartridges each one having a different colour ink supply for example black, magenta, cyan and yellow, removably mounted in a printer carriage which scans backwards and forwards across a print medium, for example paper, in successive swaths. When the printer carriage correctly positions one of the cartridges over a given location on the print medium, a jet of ink is ejected from a nozzle to provide a pixel of ink at a precisely defined location. The mosaic of pixels thus created provides a desired composite image.

Inkjet cartridges are increasingly becoming more sophisticated and complex in their construction and longer lifetimes are also required of cartridges, particularly those for use with printers having an off-carriage ink reservoir which replenishes the cartridge s ink supply. This has lead to greater sophistication in the so-called "servicing" of cartridges by a printer. It is normal for printers to have a service station at which various functions are performed on the cartridges while they are mounted in the printer carriage such as wiping, spitting and capping, see for example U.S. Pat. No. 5,585,826. Wiping comprises moving a wiper of a specified material across the printhead of a cartridge to remove paper dust, ink spray and the like from the nozzle plate of the printhead. Spitting, ejecting ink into a spittoon in the service station, is performed to prevent ink in nozzles which have not been fired for some time from drying and crusting.

Cartridges are capped by precisely moving the printer carriage, and often the cap too, within the service station, so that the cap mates with the printhead of the cartridge and forms a seal around the nozzle plate. Capping prevents ink on the printhead and in the nozzles from drying by providing the correct atmosphere around these components and thus reduces the risk of crusting and ink plug formation in the nozzles. Also the cartridge can often be primed while in the capped position by the application of a vacuum through the cap. It can thus be seen that an effective seal must be formed between the printhead and the cap to facilitate these functions. Caps are usually formed of a resiliently deformable material such as rubber and in use are ideally pressed against a printhead of a cartridge with a substantially constant force, the capping force, chosen so as to achieve an effective seal with the printhead. While this is relatively easily achieved for a printer carriage having a single cartridge, ensuring that all the cartridges of a printer carriage having a plurality of cartridges are effectively capped is considerably harder. A number of arrangements are known, see for example U.S. Pat. No. 5,563,638, in which a plurality of caps are mounted on a spring-loaded gimbal mechanism in an attempt to achieve a constant capping force between each of the caps and its respective printhead. However, manufacturing tolerances unavoidably cause there to be differences between each cap and cartridge pair and the remaining pairs. These differences can often result in different capping forces for each cap and cartridge pair so that some pairs receive insufficient capping force and others receive too great a capping force which may damage the printhead. In an attempt to alleviate these problems an improved cap has been designed as disclosed in the commonly assigned, issued U.S. Pat. No. 5,448,270 by Osbourne, which is incorporated herein by reference. Although the cap described in '270 is effective in achieving a substantially constant low capping force over a greater deflection for each cap and cartridge pair than prior caps, it has been found that there is nevertheless still undesirable and unpredictable interaction between different pairs of caps and cartridges which affects their accurate mating.

BRIEF SUMMARY OF THE INVENTION

There is provided apparatus for capping a plurality of printheads of inkjet cartridges held within the printer carriage of an inkjet printer, the apparatus comprising a service station carriage having a plurality of capping means, each for capping the printhead of an inkjet cartridge, a service station assembly in which the service station carriage is mounted and which is movable in a capping direction between a first position at which the cartridges are not capped and a second position at which the cartridges are capped, wherein relative movement in the capping direction between the plurality of cartridges and the plurality of capping means is arrested by the abutment of the service station carriage against the printer carriage. By controlling the distance between the service station carriage and the printer carriage the capping forces between a particular capping means and respective printhead are determined only by the tolerances related to the particular capping means and printhead pair and not by those related to other pairs of capping means and printheads mounted within the same service station and printer carriages.

Although the service station carriage may be rigidly mounted within the service station assembly, preferably the service station carriage is resiliently biased in the capping direction within the service station assembly by biasing means and the biasing means exert a force on the service station carriage which is greater than the total expected forces between the plurality of cartridges and the plurality of capping means so as to ensure abutment between the service station carriage and the printer carriage. In a preferred embodiment, the service station carriage is gimbal mounted within the service station assembly.

Advantageously, an uppermost side of the service station carriage comprises a plurality of mechanical stops for abutment with a corresponding plurality of mechanical stops located on a lowermost side of the printer carriage. These mechanical stops abut when the service station carriage and printer carriage are moved towards each other and thus act so as to arrest relative movement in the capping direction between the plurality of cartridges and the plurality of capping means.

In a specific embodiment, the service station carriage comprises at least three mechanical stops. A first male mechanical stop extending upwardly from the service station carriage in the form of a pin to interact with a first female mechanical stop on the printer carriage in the form of an inverted pyramid. The interaction of these two mechanical stops substantially inhibits relative translational movement between the service station carriage and the printer carriage within a plane perpendicular to the capping direction. A second male mechanical stop, also in the form of a pin, extending upwardly from the service station carriage interacts with a second female mechanical stop on the printer carriage so as to substantially inhibit relative rotational movement between the service station carriage and the printer carriage within a plane perpendicular to the capping direction. A third mechanical stop, or advantageously third and fourth mechanical stops interact with a third and fourth mechanical stop on the printer carriage so as to prevent relative movement between the service station carriage and the printer carriage solely in the capping direction.

Although the capping apparatus provided by the present invention may be advantageously utilised with caps which are designed to be mounted to the printer service station for the life of the printer, preferably the caps are mounted on a service module which is easily removable from the service station carriage by a user of the printer. Removable service modules allow the caps to be exchange frequently, for example every time a cartridge is replaced its associated service module may also be replaced. This ensures that the cap of the service module does not deteriorate in performance unduly.

To facilitate removable service modules, the service station carriage preferably comprises a plurality of slots each for slidably receiving a service module. Each slot of the service station may comprise means for urging the service module against a datum within the service station carriage with a force greater than the total expected forces between the plurality of cartridges and the plurality of capping means. This ensures that the service module is not dislodged from its datum position during a capping operation.

According to a further aspect of the present invention there is provided apparatus for capping a plurality of printheads of inkjet cartridges mounted within a carriage, comprising a plurality of capping means mounted on a common support member and biasing means for biasing the common support member towards the plurality of printheads. Relative movement in the capping direction between the capping means and the printheads is limited by a mechanical stop positioned so that the distance between each of the capping means and a respective printhead when the mechanical stop is encountered is such that an effective seal is formed between the capping means and the printhead and wherein the biasing force provided by the biasing means is sufficiently large to ensure that in use the mechanical stop is encountered.

According to a still further aspect of the present invention there is provided a method of capping a plurality of inkjet cartridges held within the carriage of an inkjet printer, each cartridge having a printhead for ejecting ink. The method comprising the steps of moving the printer carriage within the printer to a service area, moving a service station carriage having a plurality of capping means towards the printer carriage with a force greater than the total expected capping forces between the plurality of cartridges and the plurality of capping means until the service station carriage abuts the printer carriage.

A more complete understanding of the present invention and other objects, aspects, aims and advantages thereof will be gained from a consideration of the following description of the preferred embodiment read in conjunction with the accompanying drawings provided herein.

DETAILED DESCRIPTION OF THE PREFERRED EMBODIMENT OF THE INVENTION

Figure 1:
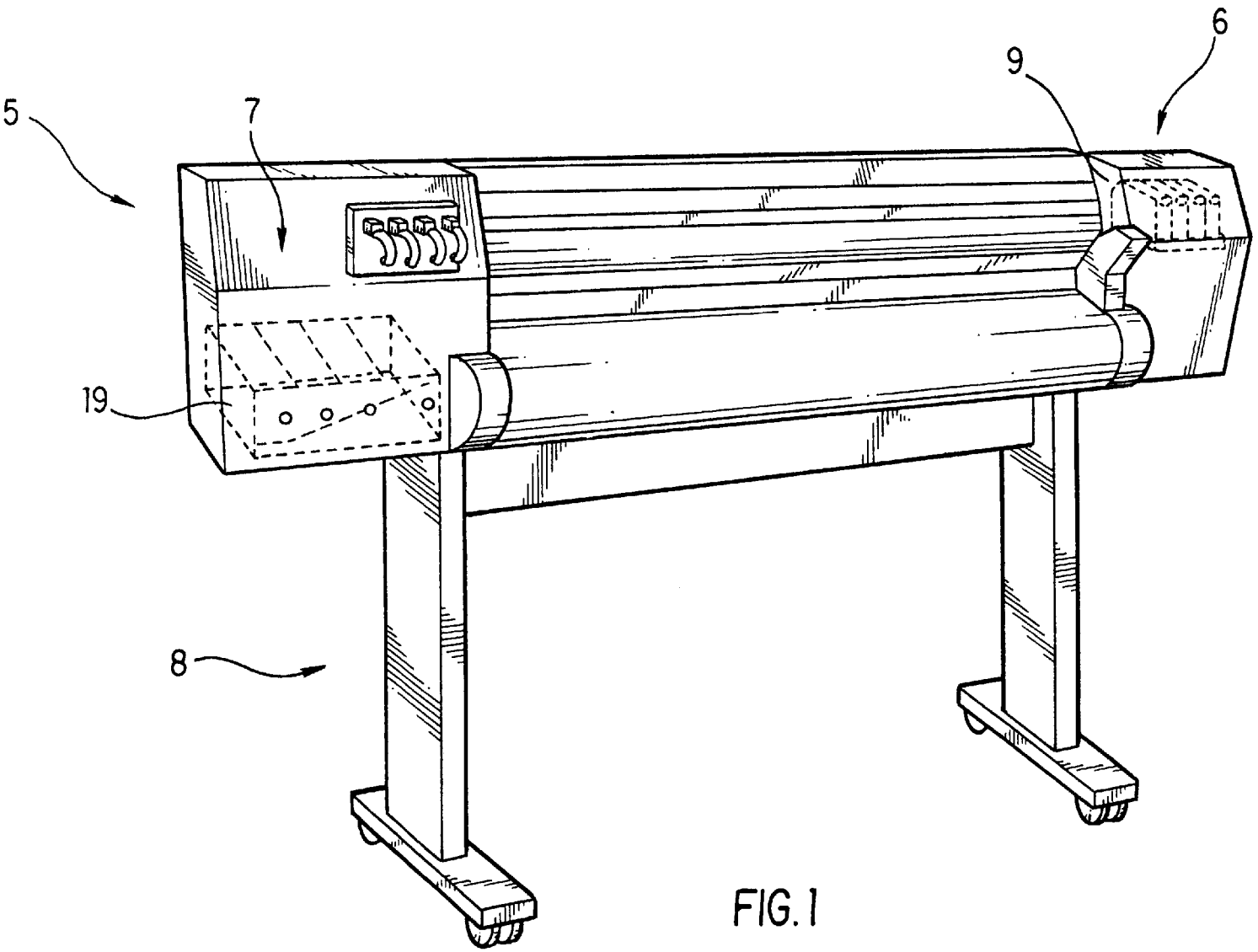
FIG. 1 is a perspective view of a large-format inkjet printer with which the capping system of the present invention may be utilised.

While the present invention is open to various modifications and alternative constructions, the preferred embodiments shown in the drawings will be described herein in detail. It is to be understood, however, that there is no intention to limit the invention to the particular form disclosed. On the contrary, the intention is to cover all modifications, equivalences and alternative constructions falling within the spirit and scope of the invention as expressed in the appended claims.

It will be appreciated that the cartridge capping system of the present invention may be used with virtually any inkjet printer, however one particular inkjet printer will first be described in some detail, before describing the capping system of the invention.

Figure 2:
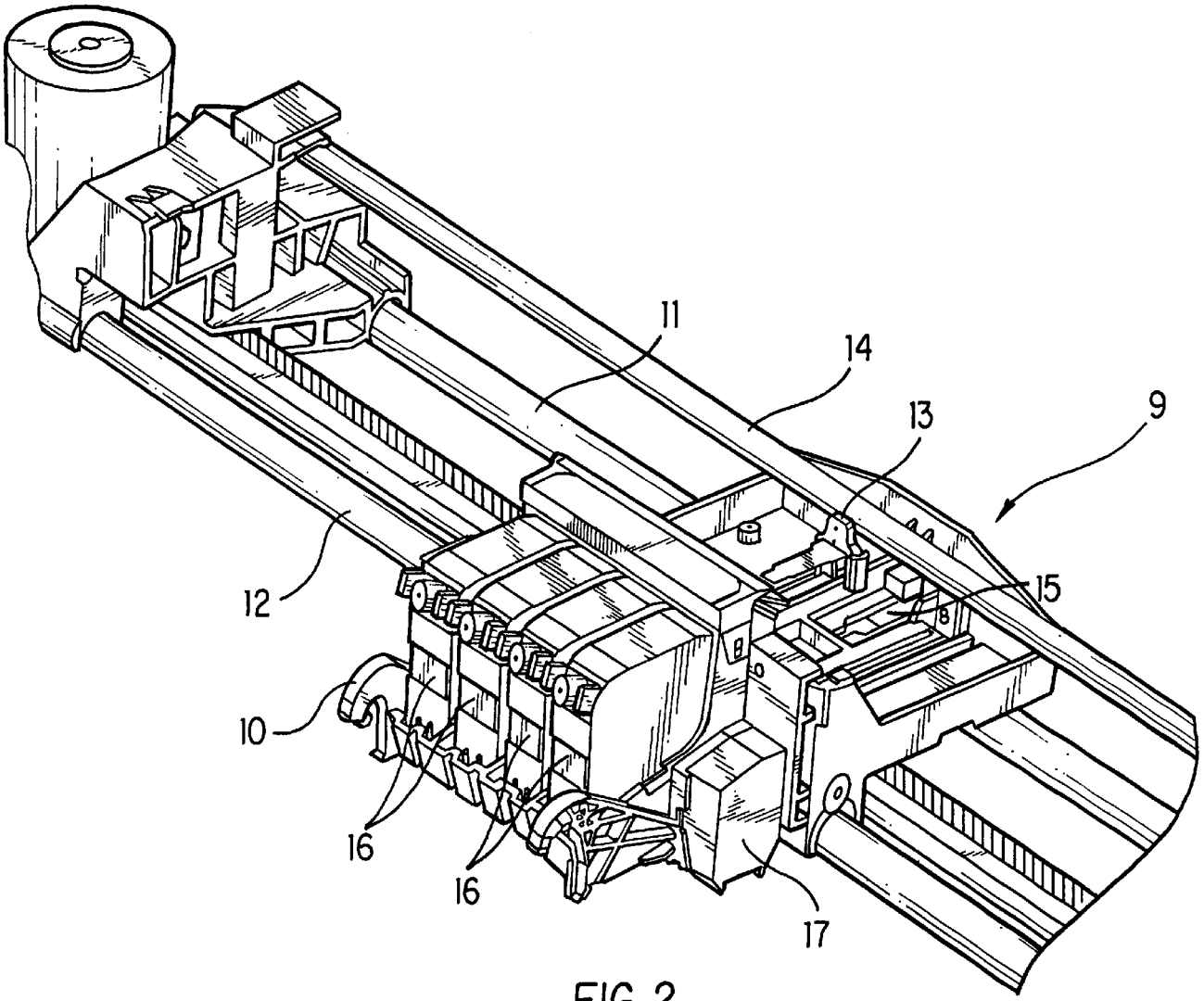
FIG. 2 is a schematic drawing of components within the print zone of the printer of FIG. 1.
Figure 3:
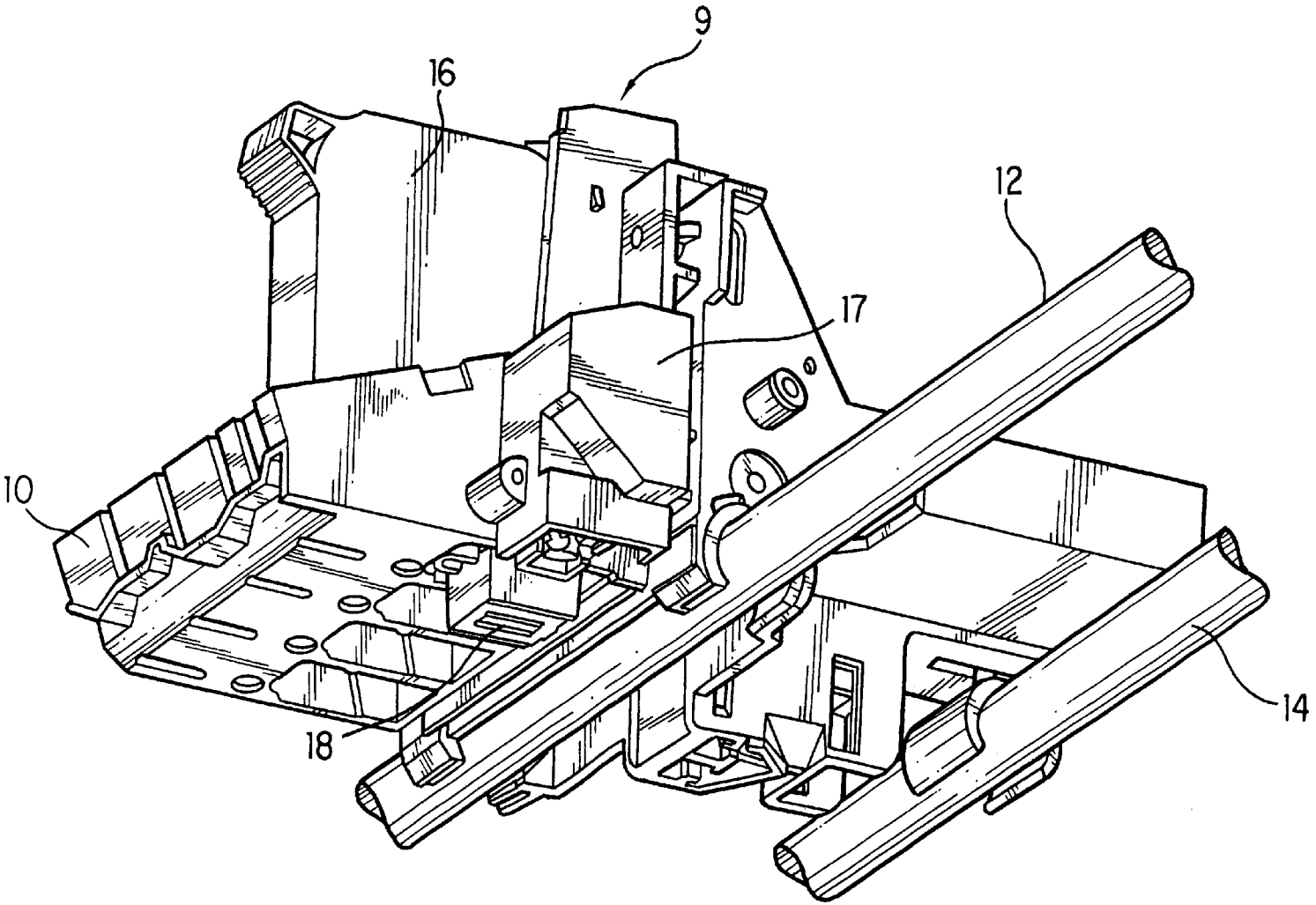
FIG. 3 is a side bottom view of the carriage assembly of the printer of FIG. 1.

FIG. 1 shows a perspective schematic view of a thermal inkjet large-format printer having a housing 5 with right and left covers respectively 6 and 7, mounted on a stand 8. A print media such as paper is positioned along a vertical or media axis by a media axis drive mechanism (not shown). As is common in the art, the media drive axis is denoted as the X axis and the carriage scan axis is denoted as the Y axis. The printer has a carriage assembly 9 shown in phantom under cover 6 and more clearly in FIG. 2 which is a perspective view of the print zone of the printer. The carriage assembly 9 has a body which is mounted for reciprocal movement along slider rods 11 and 12 and a printer carriage 10 for holding four inkjet cartridges 16 each holding ink of a different colour for example black, yellow, magenta and cyan. The cartridges are held in a close packed arrangement and each may be selectively removed from the printer carriage 10 for replacement by a fresh cartridge. The printheads of the cartridges 16 are exposed through openings in the printer carriage 10 facing the print media. On the side of the printer carriage 10 is mounted an optical sensor 17 for optically sensing test patterns printed by the cartridges 16. The carriage assembly body further retains an optical encoder 13 for determining the position of the carriage in the Y axis by interaction with an encoder strip 14, and the circuitry 15 required for interface to the heater circuits in the inkjet cartridges 16. FIG. 3 is a side-bottom perspective view of the carriage assembly 9 which better shows the mounting of the carriage and the protrusion of a printhead 18 of an inkjet cartridge 16 through the printer carriage 10 towards the print media.

Figure 4:
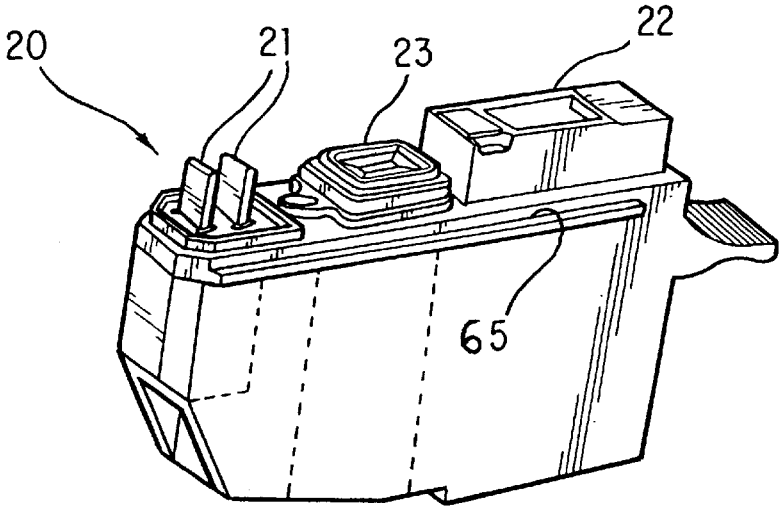
FIG. 4 is a perspective view of a service module having a cap which may be used within the capping system of the invention.

Referring again to FIG. 1 the printer has a set of replaceable ink supply modules 19 in the lefthand side of the printer (shown in phantom under the cover 7) and a set of replaceable service station modules mounted in the service station at the right-hand side of the printer (not shown). FIG. 4 shows a service station module 20 having dual wipers 21 at one end, a spittoon 22 at the other end and a cap 23 at an intermediate position. The printer has one service station module 20 per cartridge and each service station module is mounted in a service station carriage 24, shown in FIG. 5, in the service station unit 25 of the printer. The service station carriage 24 has four slots 26 for receiving service modules 20. The whole of the service station carriage is moved in two directions in a complex manner by the service station unit 25 so as to engage and disengage the carriage assembly 9 when required for servicing of the cartridges 16. The movement of the service station carriage 24 is detected and controlled by means of a motion sensor mounted on an arm 27 extending from the side of the carriage 24.

Further details of printers of the type described are disclosed in the co-pending commonly assigned application Ser. No. 08/810,485 by Rick Becker et al, filed on Mar. 3, 1997 entitled INKJET PRINTING WITH REPLACEABLE SET OF INK-RELATED COMPONENTS (PRINTHEAD/SERVICE MODULE/INK SUPPLY) FOR EACH COLOR OF INK which is incorporated herein by reference.

Figure 6A:
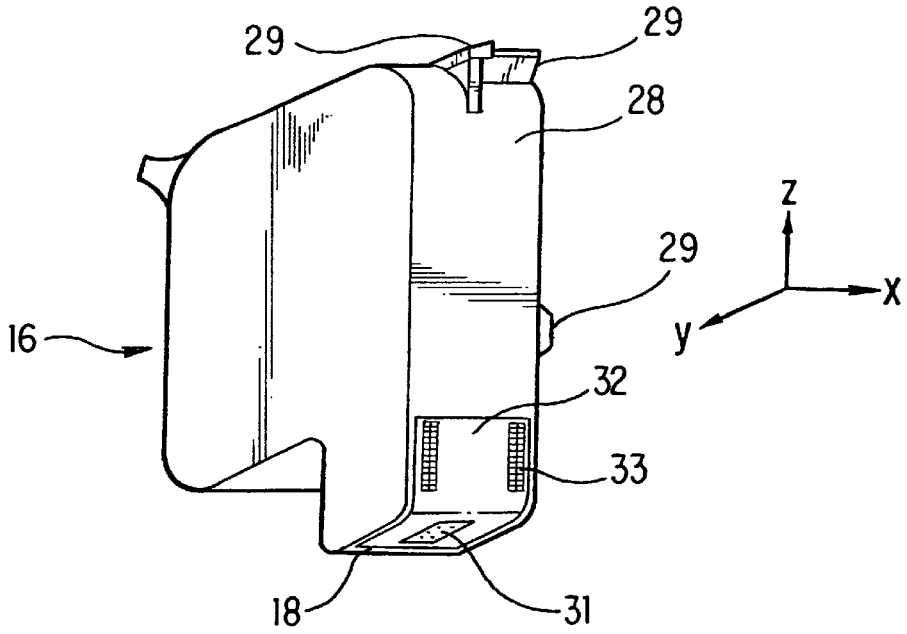
FIGS. 6A and 6B show an inkjet cartridge which may be used with the capping system of the present invention.
Figure 6B:
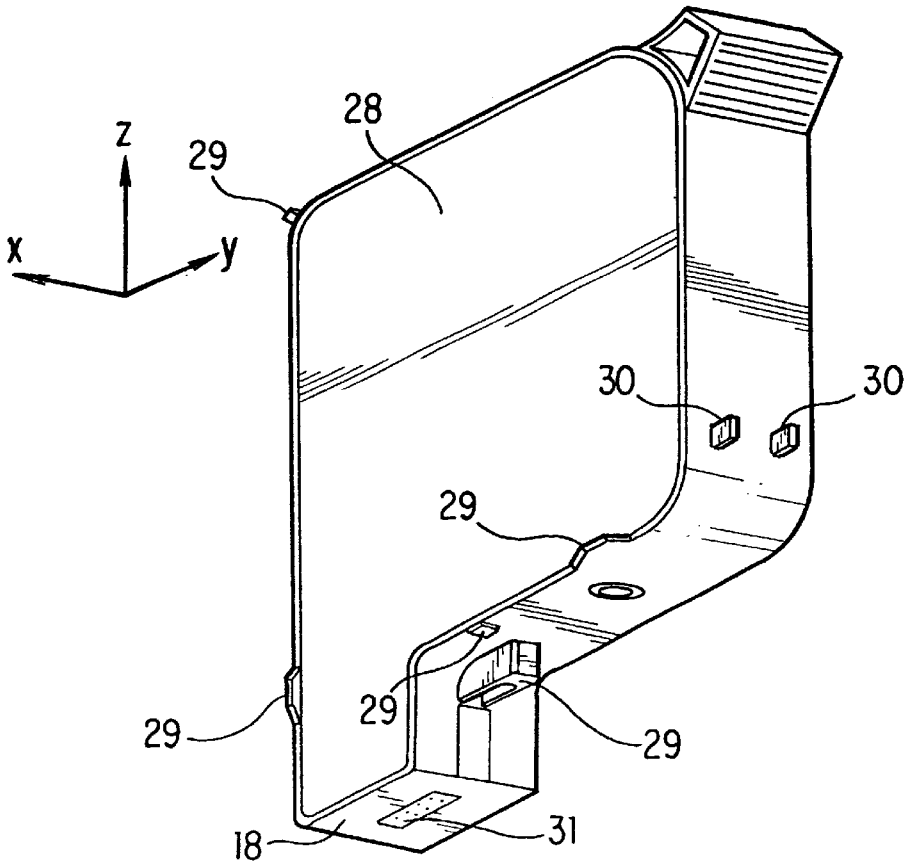

FIGS. 6A and 6B show an inkjet cartridge 16 which can be used with the printer shown in FIG. 1 and with the capping system of the present invention. The cartridge has a body 28 having an internal ink supply and various alignment features or datums 29, and keying elements 30. The printhead 18 has a nozzle plate 31 and an insulating tape 32 having electrically conductive interconnect pads 33 thereon.

Figure 7:
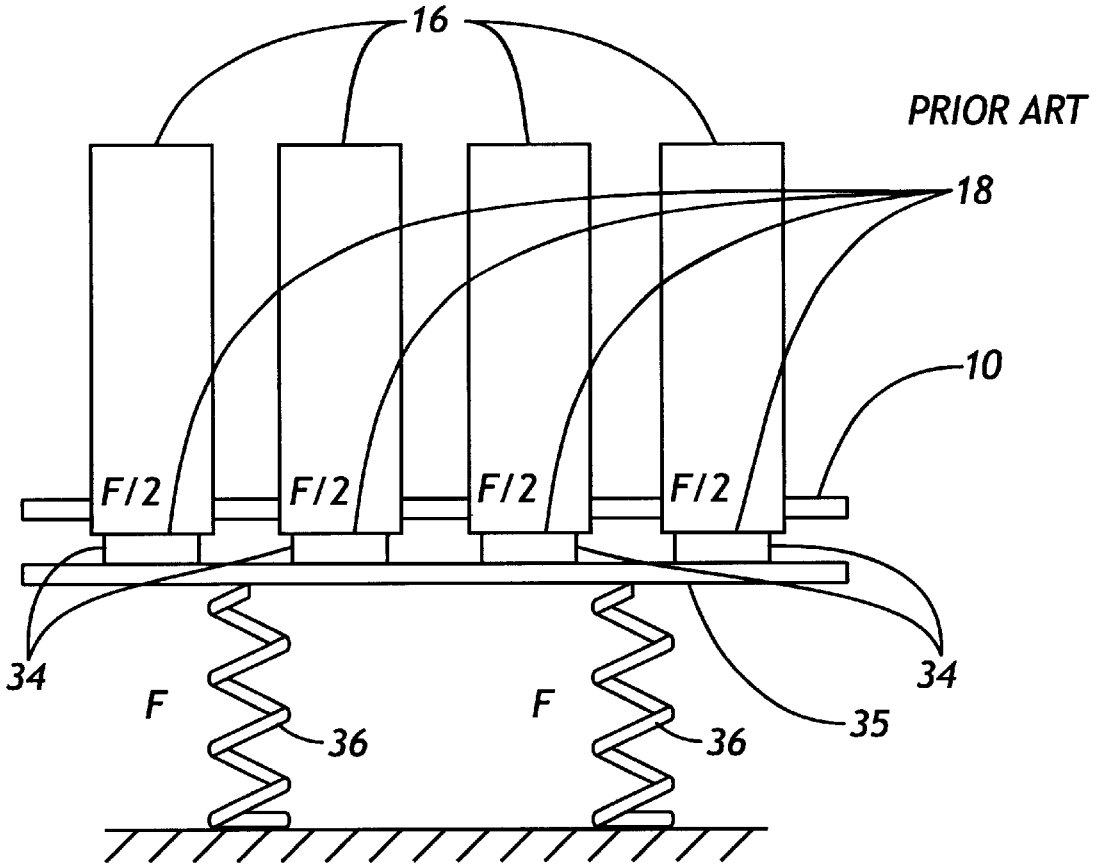
FIG. 7 is a schematic representation of a prior art capping system shown in ideal conditions.

Prior to describing a specific embodiment of the capping system of the present invention, the principles of operation of the capping system will first be described with reference to FIGS. 7, 8 and 9. FIG. 7 is a schematic representation of a prior art capping system showing four cartridges 16, each having a printhead 18, mounted in a printer carriage 10. Four caps 34 mounted on a service station carriage 35 are shown capping each of the four printheads 18. The service station carriage 35 is itself gimbal mounted on two pre-loaded springs 36, each of which exert a force F in the capping direction. In the ideal case when all of the components of this capping system are within their nominal values each of the printheads 18 experiences the same force from its respective cap 34. This type of capping system is sometimes known as a "constant force" or "force controlled" system. In this schematic example the total force exerted by the springs 36 is 2F and each printhead 18 should experience a force of F/2. The capping interference (deflection of the cap) should, in this ideal case, also be the same for all four caps and will be equal to F/(2K), where K is the equivalent spring constant of a single cap 34. It should be noted that it is the total force exerted by all of the caps 34 which is controlled rather than the force exerted by any one cap.

A problem with the prior art force controlled capping systems is that there are a large number of manufacturing tolerances which need to be taken into account in order to determine the share of the total force available that will be experienced by each of the printheads 18. In addition to the variability in the spring force, the dimension tolerances of both the caps and the cartridges, the material tolerances for the cap and the positioning tolerances of the cartridges within the printer carriage all affect the force experienced by each printhead. However, a greater problem yet is that knowledge of the exact tolerance set for any one pair of printhead and cap is not sufficient to calculate the force that will be experienced by that particular pair in a prior art force controlled capping system. This is because the actual force experienced by each of the pairs also depends on the exact tolerance set for all of the remaining pairs of printhead and cap mounted within the same printer and service station carriages. Thus when designing a constant force capping system each extreme of each tolerance range for each variable for each printhead/cap pair must be taken into account. This leads to complex iterative modelling which, while of some accuracy for systems having a small number (one or two) cartridges, is insufficiently accurate for systems having a relatively large number of cartridges, such as four cartridges. Furthermore, if the service station carriage 35 on which the caps 34 are mounted is mounted to have a gimballing action, when initial contact is made between one cap 34 and one printhead 18 the service station carriage 35 will be displaced and the modelling of its interaction with the remaining printheads is complicated still further.

Figure 8:
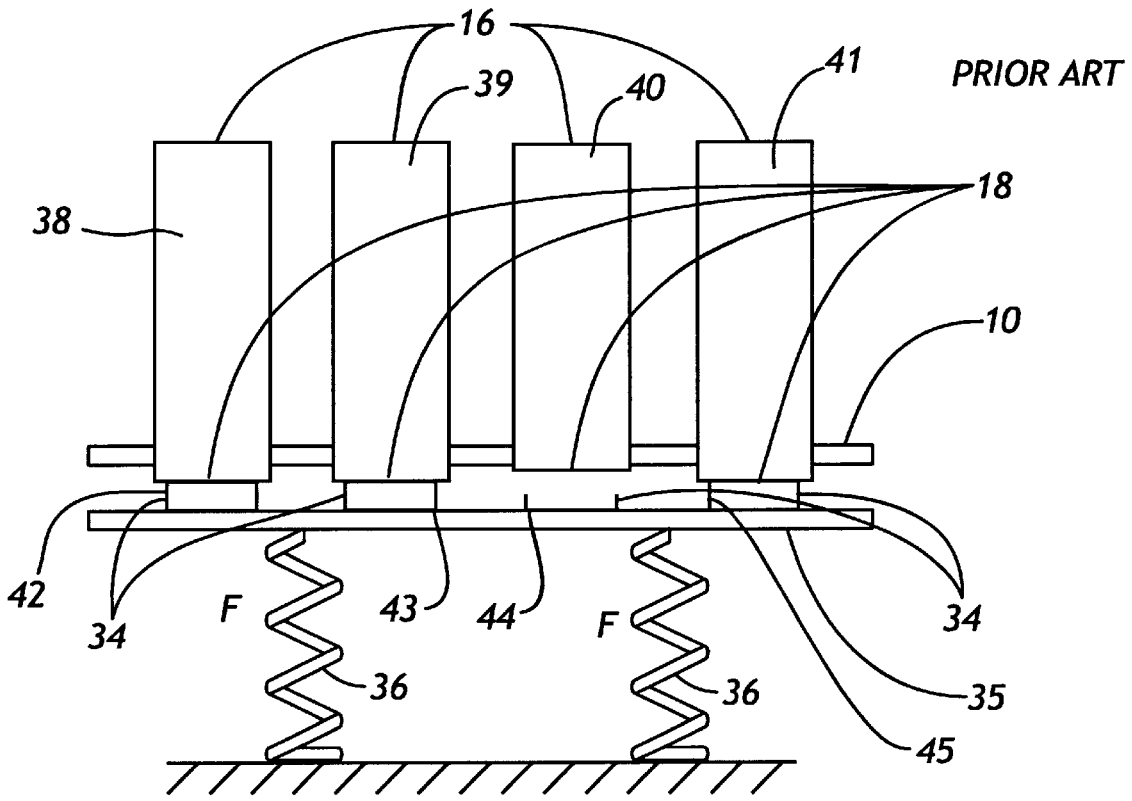
FIG. 8 is a schematic representation of the capping system of FIG. 7 shown in non-ideal conditions.

FIG. 8 shows an example of the effects of an inaccurate prior art capping system. Cartridges 38, 39 and 41are longer than cartridge 40 i.e. their length from their referenced position within the printer carriage 10 to their printhead 18 is at one end of the manufacturing tolerances. Cartridge 40 is however at the other end of its manufacturing tolerances and is short. Furthermore cap 44 for capping cartridge 40 is also shorter than caps 42, 43 and 45. The result is that the printhead of cartridge 40 is not capped with sufficient force while the printheads of cartridges 38, 39 and 41 are capped with excessive force. So while the force across all four cartridges remains constant, it is in fact shared by only three of the cartridges. This inaccurate capping is likely to arise in force controlled capping systems with a relatively large number of cartridges because the allowable variability in any one cartridge/cap pair depends on the actual tolerances for the other pairs within the system.

Figure 9:
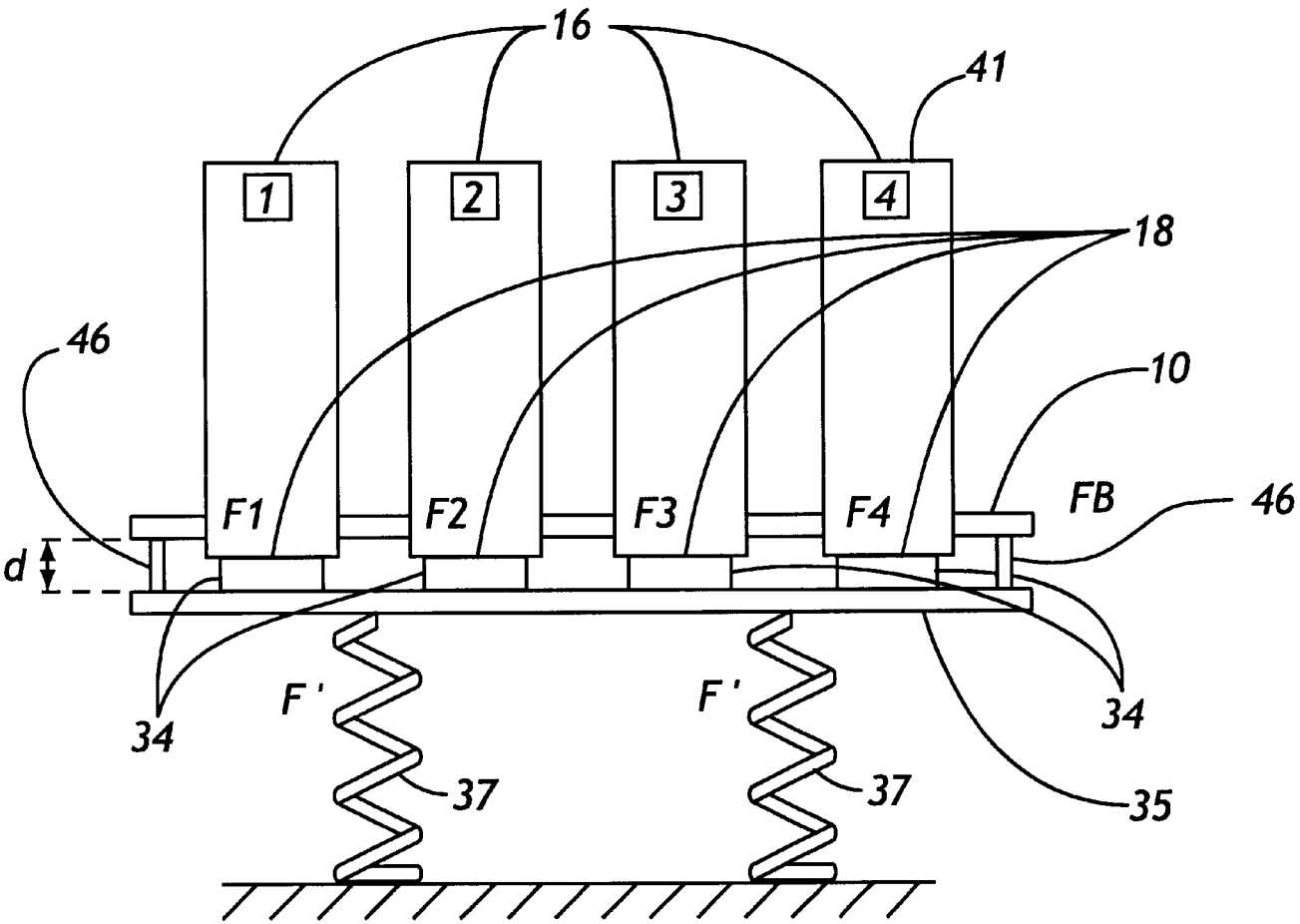
FIG. 9 is a schematic representation of a capping system according to an embodiment of the present invention.

FIG. 9 is a schematic representation of a capping system according to an embodiment of the present invention. The schematic arrangement is similar to that of the prior art force controlled capping system shown in FIGS. 7 and 8 except that mechanical stops 46 are provided between the printer carriage 10 and the service station carriage 35. These mechanical stops 46 limit the approach of the service station carriage 35 to the printer carriage 10 and define a fixed distance d between the two carriages. Also the springs 37 in this arrangement generate a force 2F' which is large enough to ensure that the mechanical stops, rather than the capping forces generated between the four pairs of printheads 18 and cap 34, limit the approach of the carriages 10 and 35 to each other. Thus a part of the the force 2F' is bore by the mechanical stops 46 and a part of the force 2F' is bore by the caps and printheads. This arrangement ensures that, in the capping position, the deflection of any one cap by its respective printhead (and thus the capping force) depends only on the tolerances associated with that particular cap and printhead and does not depend at all on the actual tolerances of the remaining cap/printhead pairs in the system. This means that modelling of the capping system is extremely easy and in practice has meant that far few capping problems are encountered.

Figure 10:
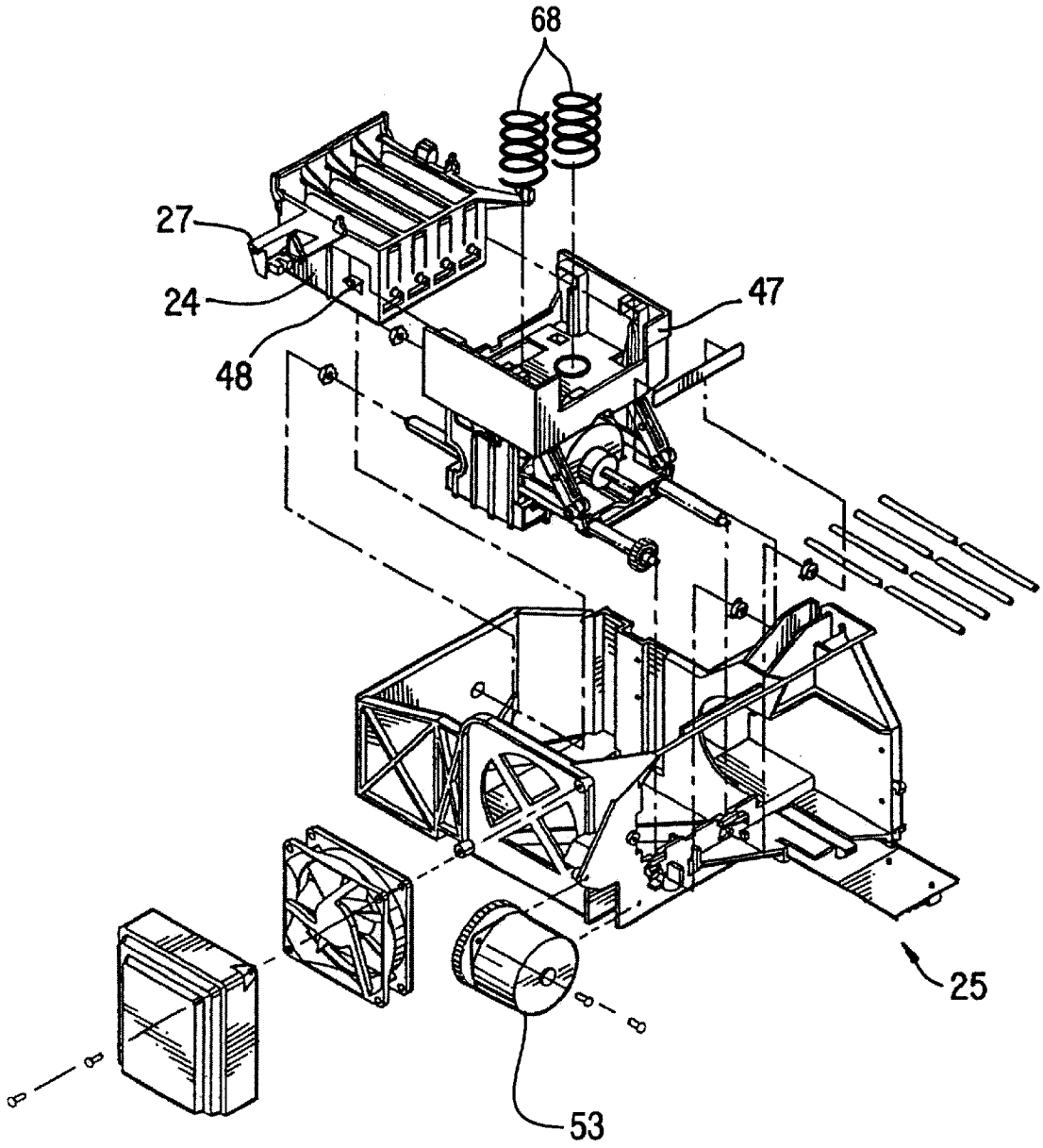
FIG. 10 is an exploded view of the service station unit of the printer of FIG. 1.

Returning now, with reference to FIGS. 5 and 10, to the description of the service station unit 25, the service station carriage 24 is mounted within a service station assembly 47. As best seen in the exploded view of the service station unit 25 shown FIG. 10, the service station carriage 24 is mounted on two springs 68 within the service station assembly 47. Each of these springs 68 exert a force F' chosen so that 2F' is greater than the total expected capping forces between the four cartridges 16 mounted within the printer carriage 10 and the four caps 23 of the four service station modules 20 mounted within the slots 26 of the service station carriage 24. The service station carriage 24 has four pegs 48, two extending from each of its outer side walls 49, (shown in FIG. 11) which abut downwardly facing arms 50 extending from the inner side walls 51 (shown in FIG. 12) of the service station assembly 47. The service station carriage 24 is upwardly biased by the springs 68 acting against its base 52 until the pegs 48 on its walls 49 contact the arms 50 of the service station assembly 47. This provides a "floating" mounting to the service station carriage 24 and allows it to gimbal to some extent to mate with the printer carriage 10.

Each of the slots 26 of the service station carriage 24 has a Z datum ridge 66 along a top portion of the slot which engages a corresponding datum ledge 65 (as shown in FIG. 4) along both top edges of the service module 20. Each slot 26 also comprises an upwardly biased spring arm (not shown) which ensures that each service module 20 snaps into place in its respective slot 26 and is held against the datum ridge 66. The force generated by the spring arm is arranged to be far greater than the forces generated during capping of a printhead 18 by the cap 23 of a service module 20 to ensure that there is no movement of the service module 20 during the capping operation.

Figure 5:
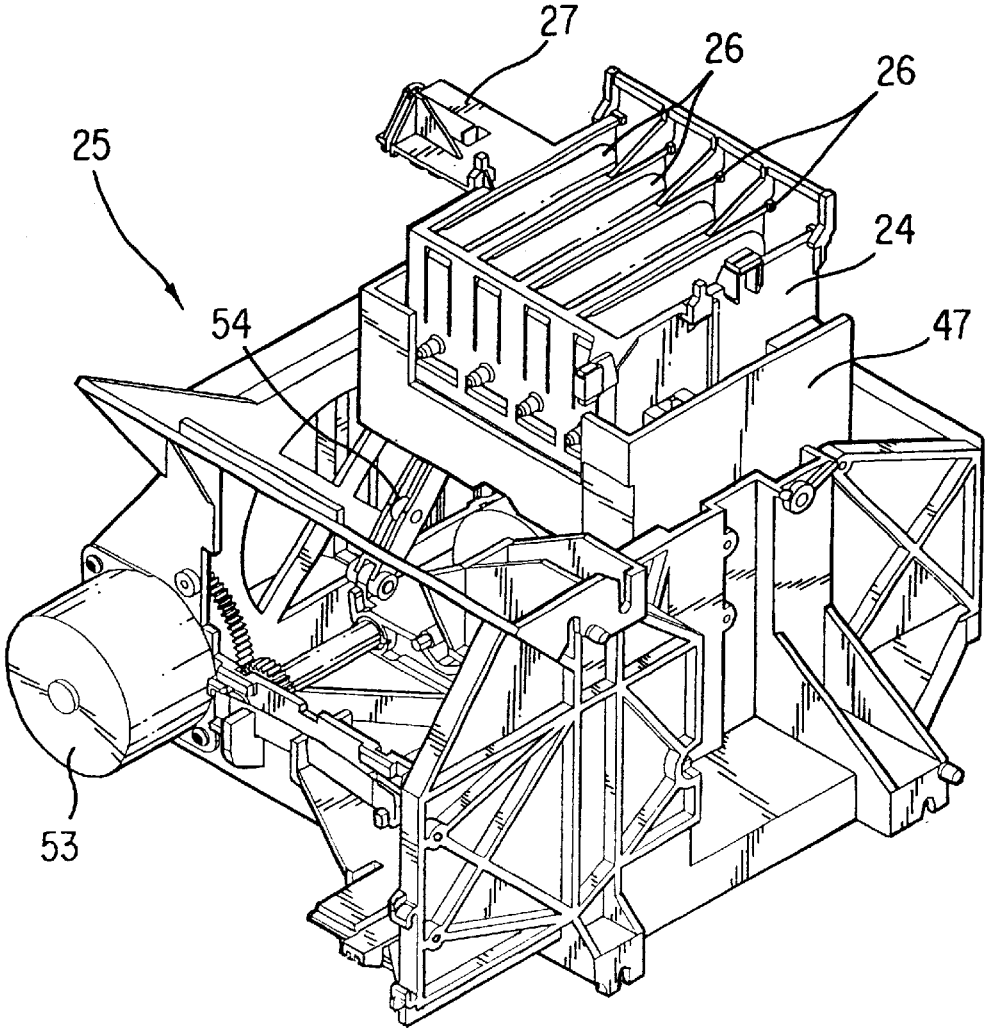
FIG. 5 is a perspective rear view of the service station unit of the printer of FIG. 1.
Figure 12:
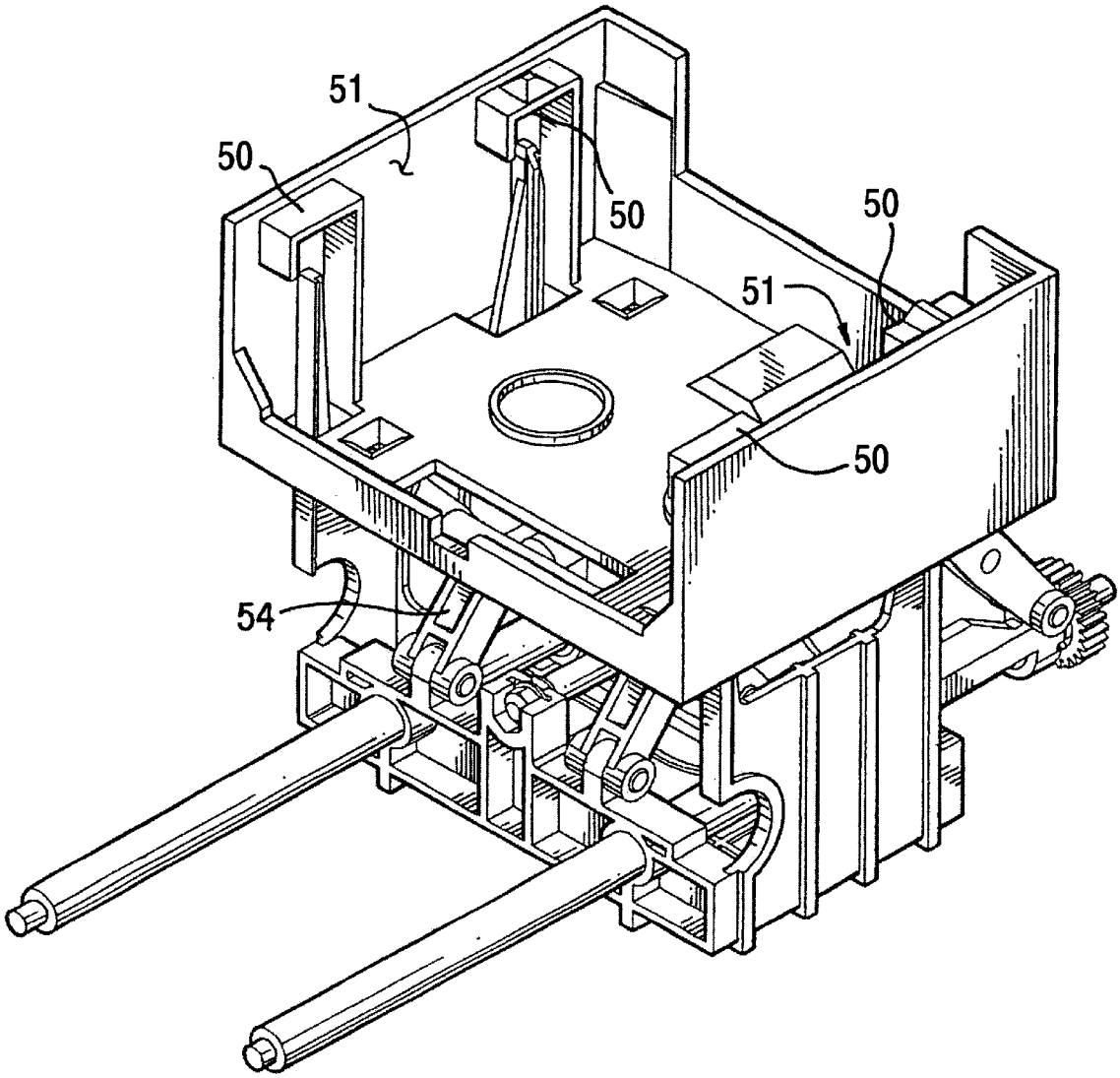
FIG. 12 shows a service station assembly on which the service station carriage of FIG. 11 is mounted.

Referring to FIGS. 5 and 12 the service station assembly 47 is movable in the X direction by a motor 53 which drives a worm drive, and in the Z direction (i.e. the capping direction) via a linkage 54.

Figure 11:
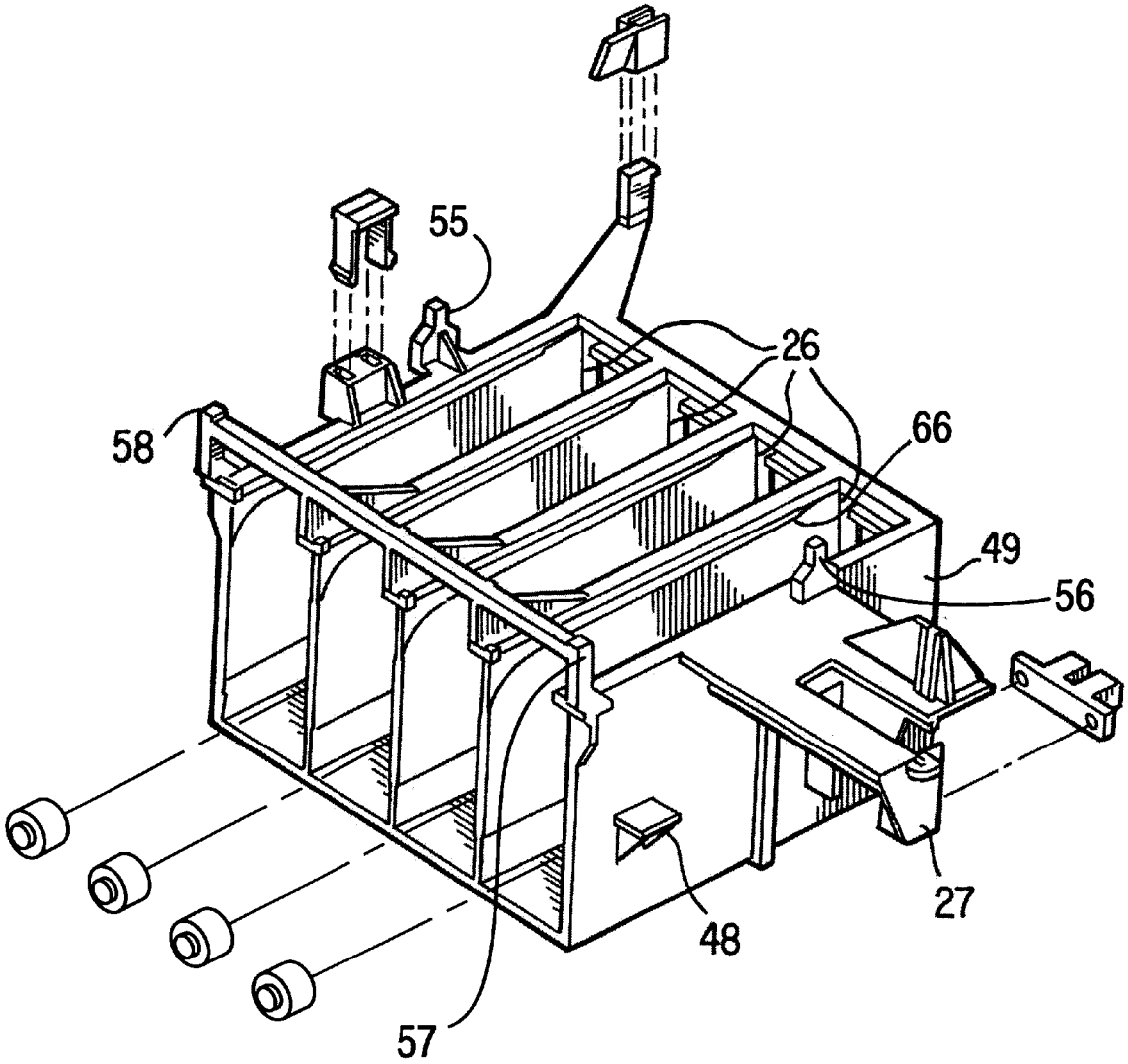
FIG. 11 shows a service station carriage according to an embodiment of the present invention.

Mechanical stops are provided on the upper surface of the service station carriage 24, as shown in FIG. 11, in the form of two free-standing upwardly extending pins 55 and 56 and two linked pins 57 and 58.

Figure 13:
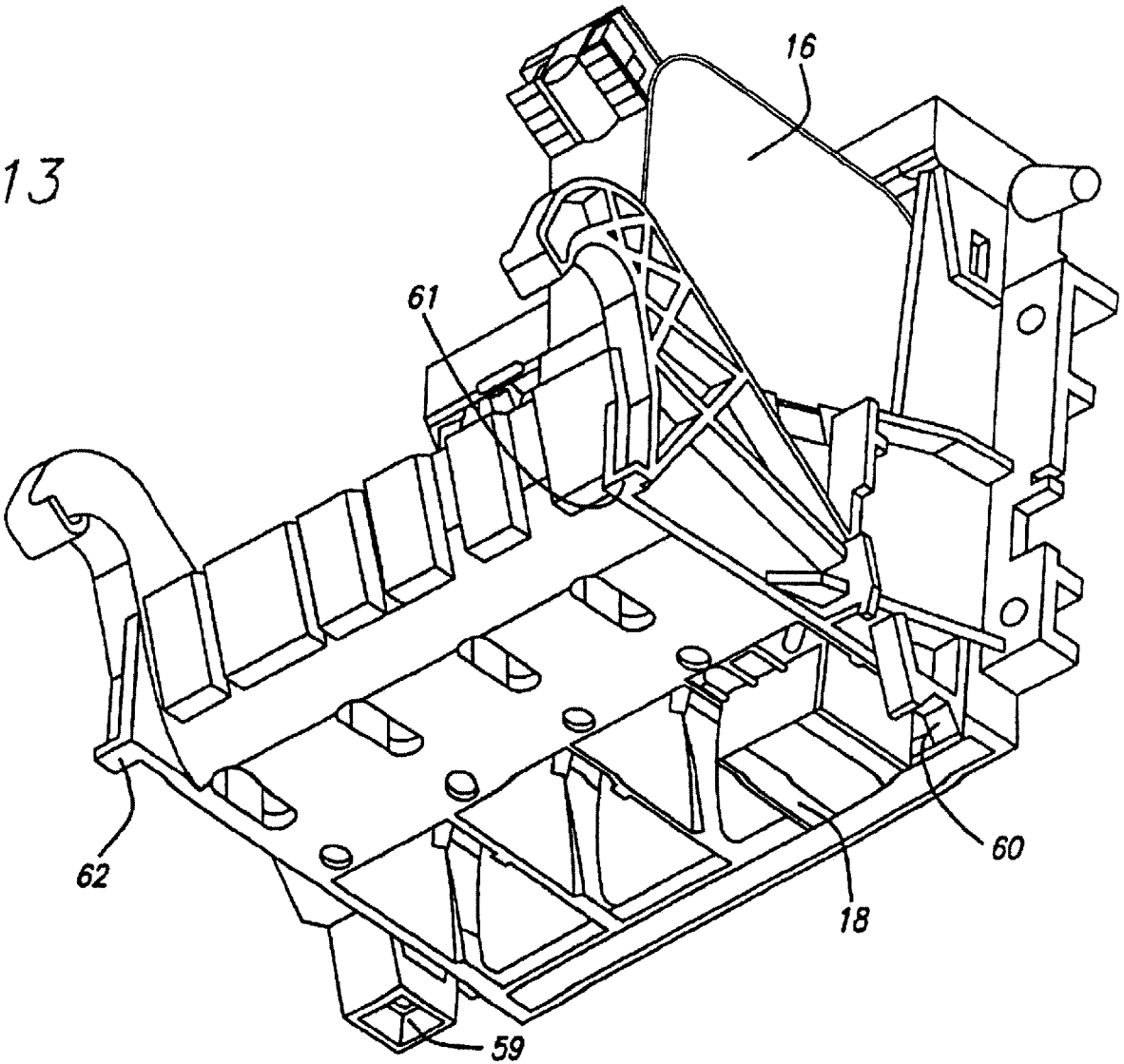
FIG. 13 is a lower perspective view of the printer carriage of the printer of FIG. 1 with a single cartridge installed.

FIG. 13 is a lower perspective view of the printer carriage 10 with a single cartridge 16 installed in a compartment showing the printhead 18 of the cartridge protruding through the base of the printer carriage for engagement with a cap 23 of a service module 20 mounted in the service station carriage 24 below the printer carriage. Also shown on the lower surface of the printer carriage 10 are mechanical stops 59, 60, 61 and 62 for engagement with the pins 55, 56, 57 and 58 of the service station carriage 24. Mechanical stop 59 is in the form of an inverted pyramid into which the pin 55 may enter to provide referencing between the printer carriage 10 and the service station carriage 24 in the X and Y directions in addition to the Z or capping direction. Mechanical stop 60 is in the form of a V-shaped slot into which pin 56 may enter to provide referencing in the X direction (in addition to the Z direction) so as to prevent rotation of the printer and service station carriages about the pin 55. Mechanical stops 61 and 62 are in the form of flat lands which provide referencing only in the Z direction by abutting against the pins 57 and 58 of the service station carriage 24.

Figure 14:
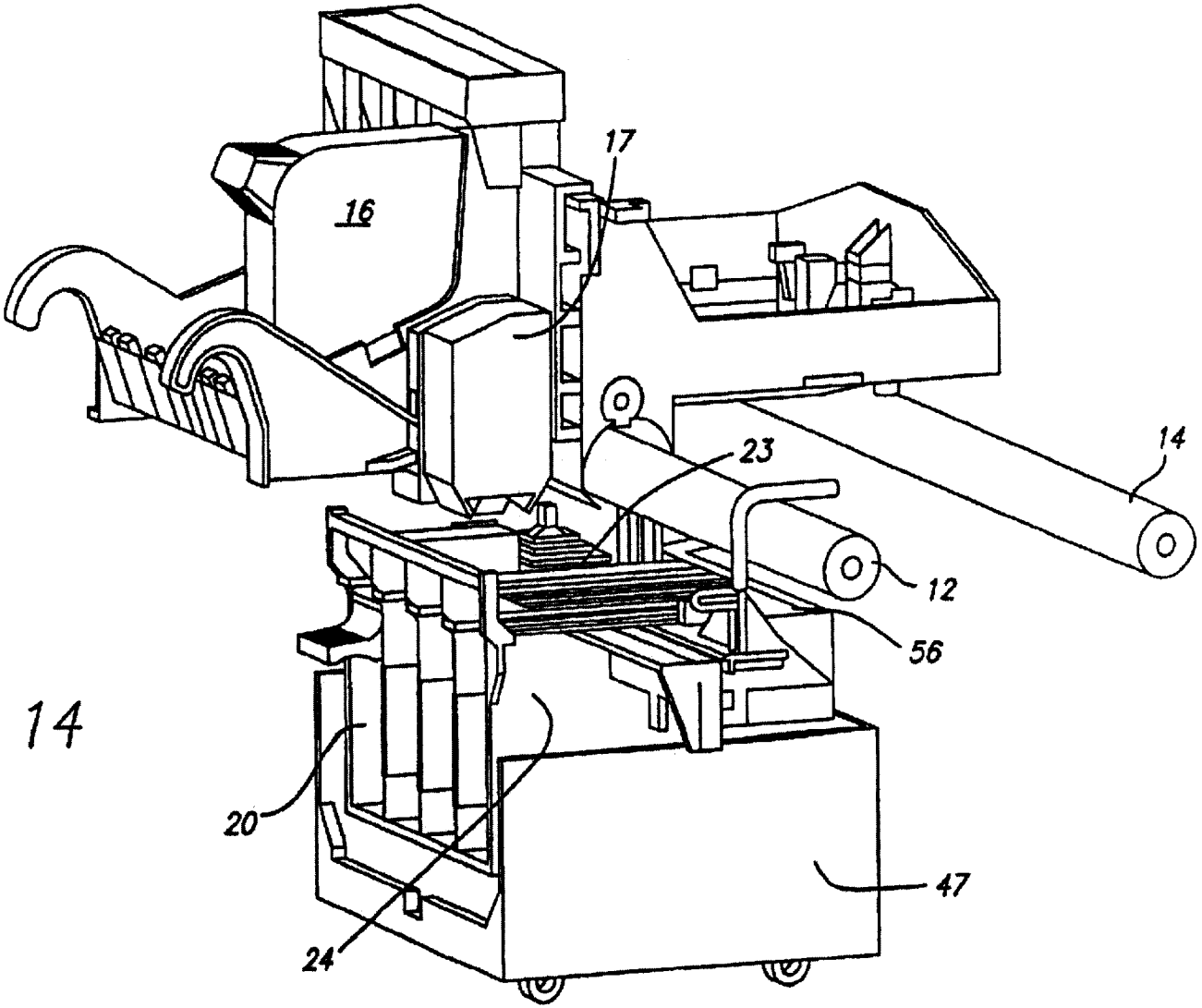
FIG. 14 shows the carriage assembly, including the printer carriage moving in the Ydirection along slider rods to the right hand side of the printer where the service station is located.
Figure 17:
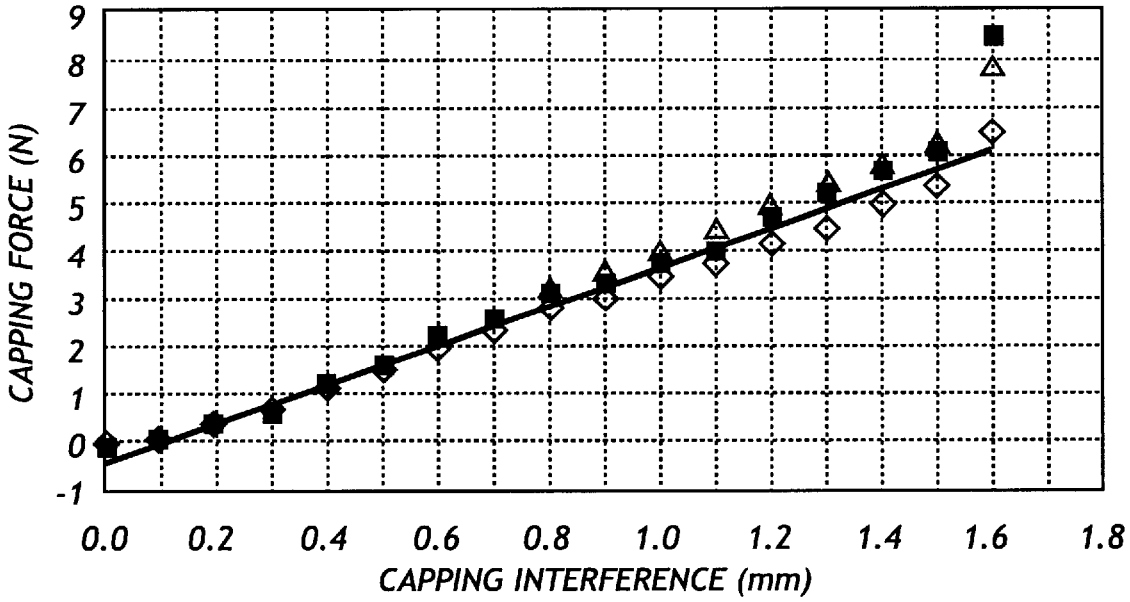
FIG. 17 is a graph showing measured capping force against measured capping interference for a particular cap.

FIG. 14 shows the carriage assembly, including the printer carriage 10 (shown holding only one rather than four cartridges for clarity) moving in the Ydirection along the slider rods 12 and 14 to the right hand side of the printer where the service station is located. Also shown are the service station assembly 47 and the service station carriage 24 holding only one rather than four service modules 20 again for the sake of clarity. In order to perform a capping operation, the carriage assembly aligns the printer carriage with the service station carriage in the Y direction and the service station assembly is moved in the X direction and then the Z direction. As the service station carriage 24, within the service station assembly 47 is moved in the Z direction the caps 23 of the four service modules 20 contact the printheads of the four cartridges 16. The caps 20 are slightly deflected and form a seal around the printheads 18 shortly before the mechanical stops 55, 56, 57 and 58 of the service station carriage 24 abut the mechanical stops 59, 60, 61 and 62 of the printer carriage 10. The abutment of the mechanical stops defines a fixed separation between the service station carriage 24 and the printer carriage 10. Thus the desired deflection of the cap (sometimes called the capping interference) can be easily set when designing the capping system and, since the relationship between capping interference and capping force can be measured (for example as shown in FIG. 17), the desired capping force is also easily set. Furthermore, since the capping interference for a particular cap and printhead pair is unaffected by that for any other pair it is far easier to ensure that the tolerances affecting one pair are such as to always achieve an effective capping interference.

The floating mounting of the service station carriage 24 within the service station assembly 47 ensures that any misalignment between the two carriages is corrected and also that any further movement of the carriage assembly 47 in the Z direction once capping has occurred does not cause additional forces to be exerted on either the printer carriage 10 or the cartridges 16.

Figure 15A:
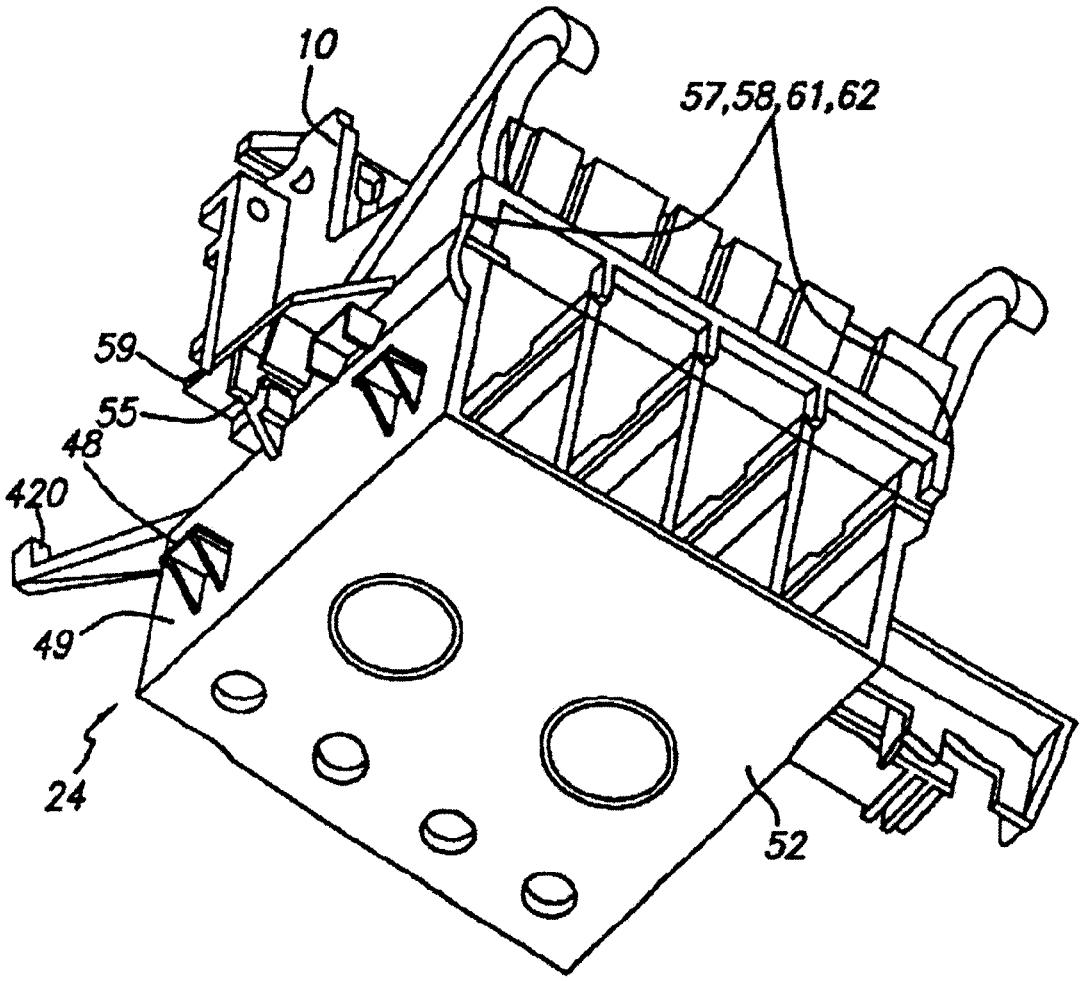
FIG. 15A shows a lower front perspective view of the service station carriage fully engaged with the printer carriage.
Figure 15B:
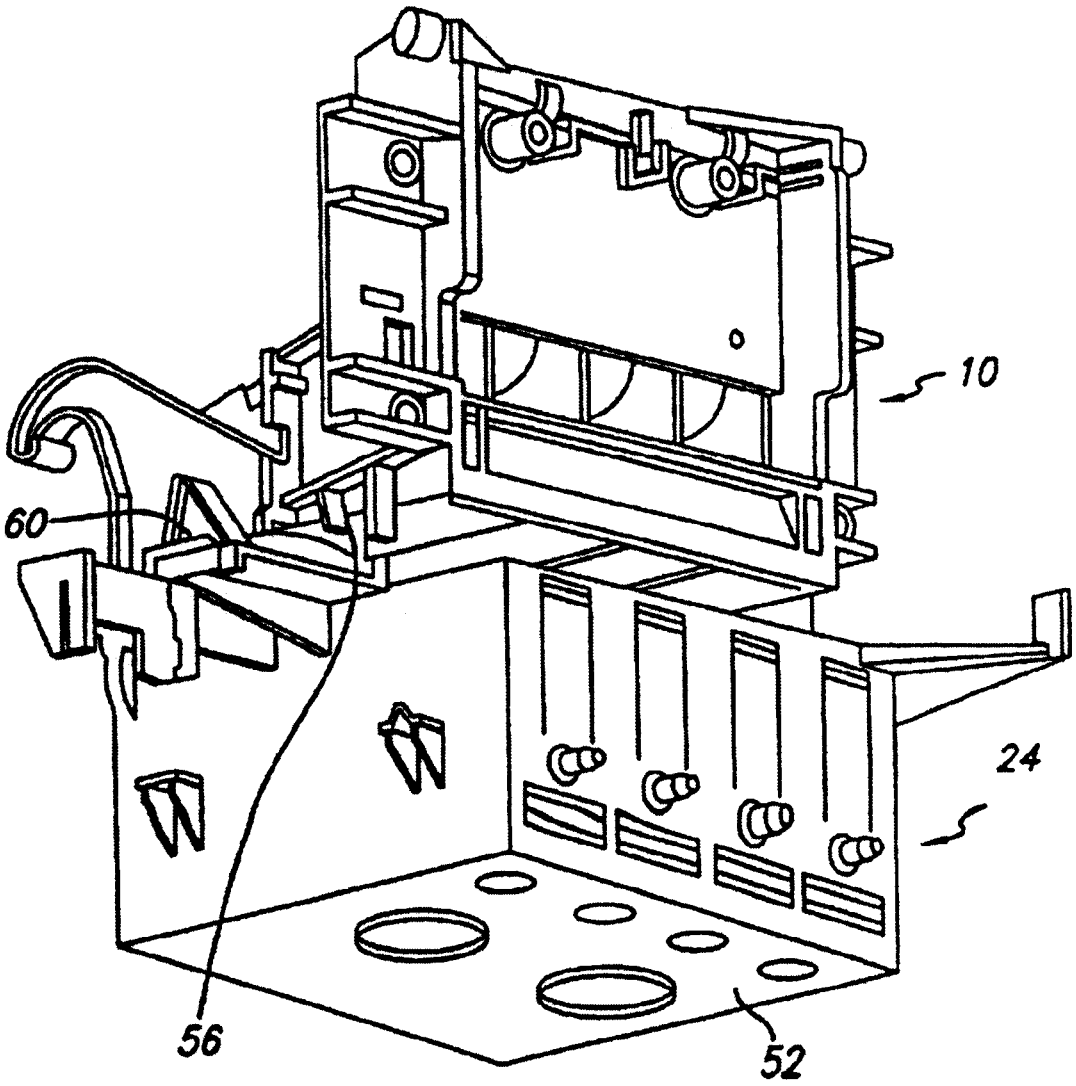
FIG. 15B shows a lower rear perspective view of the service station carriage fully engaged with the printer carriage.
Figure 16:
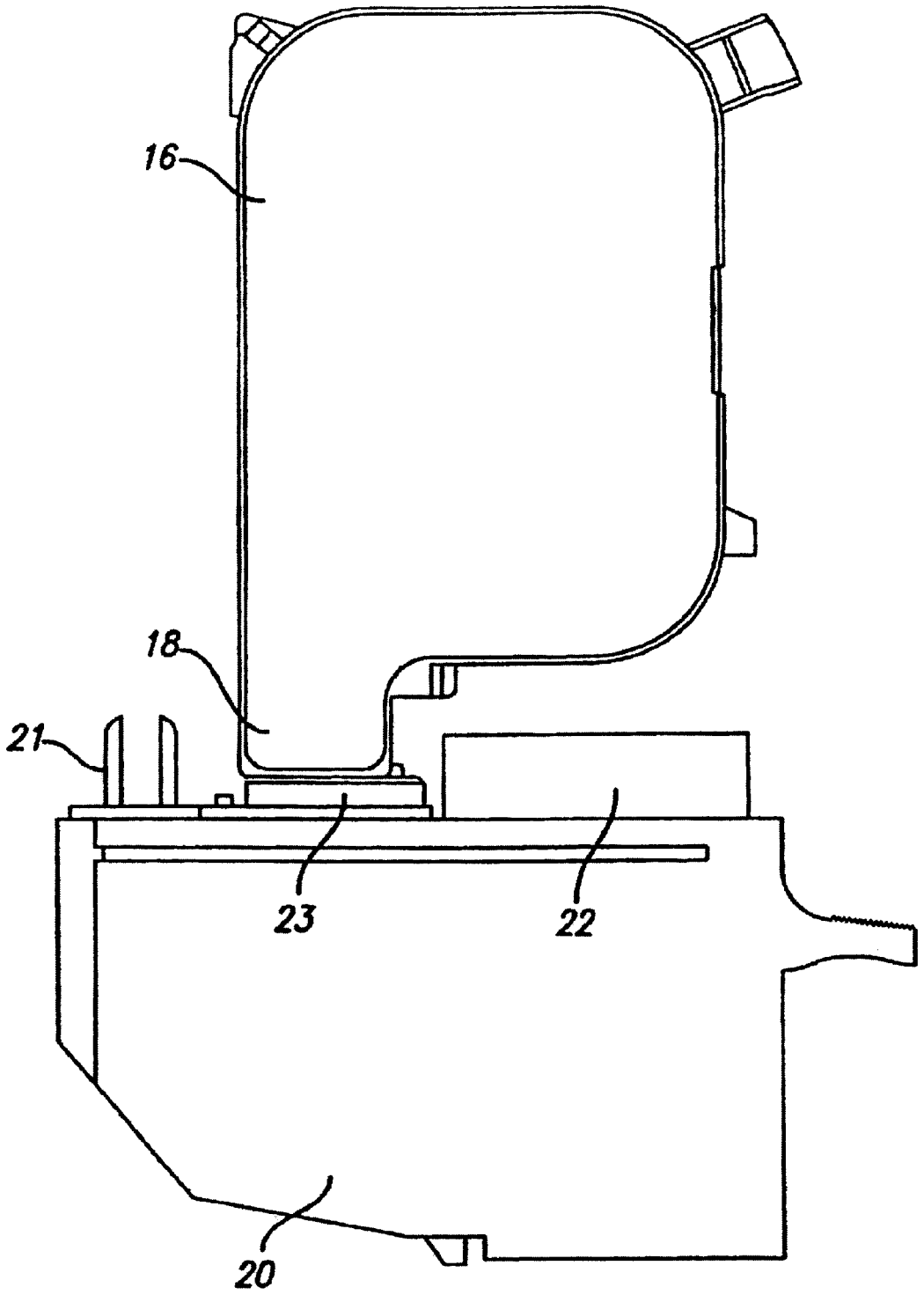
FIG. 16 shows a side view of a single service module 20 in capping engagement with a cartridge.

FIG. 15A shows a lower front perspective view of the service station carriage 24 fully engaged with the printer carriage 10 without any other components of the printer so that the engagement of mechanical stops 55 and 59 and 57, 58 and 61, 62 can be seen. FIG. 15B shows a lower rear perspective view of the service station carriage 24 fully engaged with the printer carriage 10 without any other components of the printer so that the engagement of mechanical stops 56 and 60 can be seen. FIG. 16 shows a side view of a single service module 20 in capping engagement with a cartridge 16 without any other components of the printer so that their relative configuration can be seen.

What is claimed is:

1. Apparatus for capping a plurality of printheads of inkjet cartridges held within a printer carriage of an inkjet printer, comprising:

a service station having a plurality of capping members which independently undergo cap deflection upon contact with the printhead of an inkjet cartridge;

a service station assembly in which a service station carriage is mounted, said service station carriage collectively holding said plurality of capping members to be movable together as a unit in said service station carriage in a longitudinal Z axis capping direction between a first position at which the cartridges are spaced apart from the capping members to be not capped and a second fixed position at which the cartridges are in sealing capped contact with the capping members, the amount of cap deflection of each capping member at said second fixed position creating a proportional amount of sealing cap deflection force against each printhead, respectively;

biasing means for exerting a biasing force in the longitudinal Z axis direction against said service station carriage, said biasing force greater than the total expected cap deflection forces between the plurality of cartridges and the plurality of capping members so as to ensure an abutment between said service station carriage and the printer carriage while said capping members are in sealing contact with the cartridges; and wherein additional undesirable relative movement in the longitudinal Z axis capping direction between the plurality of cartridges and the plurality of capping members in said second fixed position is arrested by mechanical stop means for creating the abutment of the service station carriage against the printer carriage, said abutment occurring separate from and in addition to the aforesaid sealing capped contact between the capping members and the cartridges.

2. Apparatus as claimed in claim 1, wherein an uppermost side of the service station carriage comprises a plurality of mechanical stops for abutment with a corresponding plurality of mechanical stops located on a lowermost side of the printer carriage so as to arrest relative movement in the capping direction between the plurality of cartridges and the plurality of capping members.

3. Apparatus as claimed in claim 2, wherein the service station carriage comprises an upwardly extending male mechanical stop and the printer carriage comprises a cooperating female mechanical stop and wherein interaction between said male and said female mechanical stops additionally substantially inhibits relative translational movement between the service station carriage and the printer carriage within a plane perpendicular to the capping direction.

4. Apparatus as claimed in claim 2, wherein the service station carriage comprises an upwardly extending male mechanical stop and the printer carriage comprises a cooperating female mechanical stop and wherein interaction between said male and said female mechanical stops additionally substantially inhibits relative rotational movement between the service station carriage and the printer carriage within a plane perpendicular to the capping direction.

5. Apparatus as claimed in claim 2, wherein the service station carriage comprises three mechanical stops;

a first male mechanical stop extending upwardly from the service station carriage to interact with a first female mechanical stop on the printer carriage so as to substantially inhibit relative translational movement between the service station carriage and the printer carriage within a plane perpendicular to the capping direction, a second male mechanical stop extending upwardly from the service station carriage and to interact with a second female mechanical stop on the printer carriage so as to substantially inhibit relative rotational movement between the service station carriage and the printer carriage within a plane perpendicular to the capping direction, and a third mechanical stop to interact with a third mechanical stop on the printer carriage so as to prevent relative movement between the service station carriage and the printer carriage solely in the capping direction.

6. Apparatus as claimed in claim 1, wherein each of said capping members is mounted on a service module and said service module is easily removable from the service station carriage by a user of the printer.

7. Apparatus as claimed in claim 6, wherein the service station carriage comprises a plurality of slots each for slidably receiving a service module.

8. Apparatus as claimed in claim 7, wherein each said slot of the service station carriage comprises at least one datum for providing positional restraint to a service module within said slot so that the capping member of said service module is correctly positioned to receive the printhead of an associated inkjet cartridge.

9. Apparatus as claimed in claim 8, wherein each slot of the service station comprises means for urging the service module against the datum with a force greater than the total expected forces between the plurality of cartridges and the plurality of capping members so as to ensure that the service module is not dislodged from its datum during a capping.

10. Apparatus for capping a plurality of printheads of inkjet cartridges mounted within a printer carriage, the apparatus comprising:

a plurality of capping means mounted on a common support member such that said plurality of capping means and said common support member together form a capping unit; and biasing means for biasing the common support member and said capping means together as a unit in a longitudinal Z axis capping direction towards the plurality of printheads, wherein relative movement in a longitudinal Z axis capping direction between the capping means and the printheads is limited by a mechanical stop which is separate from the capping means and is positioned to define a fixed separation between the printer carriage and the capping unit so that the distance between each of the capping means and a respective printhead when the mechanical stop is encountered is such that a cap deflection of the capping means in the longitudinal Z axis capping direction creates a proportional cap deflection force and forms an effective seal between the capping means and each printhead and wherein the biasing force provided by the biasing means is sufficiently greater than said cap deflection force to ensure that the mechanical stop remains encountered during such deflection of the capping means.

11. A method of capping at least two inkjet cartridges held within the carriage of an inkjet printer, each cartridge having a printhead for ejecting ink, the method comprising the following:

the printer carriage within the printer to a service area;

providing a service station carriage;

providing a plurality of caps on the service station carriage corresponding to the at least two inkjet cartridges, respectively, with the caps capable of deflection in response to a capping force;

moving the service station carriage towards the printer carriage by applying a predetermined force in a longitudinal Z axis direction greater than said capping force so that the plurality of caps are deflected upon capping contact with the at least two inkjet cartridges thereby creating a proportional capping force to provide a seal around each printhead, respectively, while at the same time said predetermined force achieves direct fixed abutment in the longitudinal Z-axis direction by the combination effect of the mechanical stops between the printer carriage and the service station carriage to hold the printer carriage and the service station carriage a predetermined distance apart, and wherein said abutment is separate and apart from the capping contact.

12. The method of claim 11 wherein said predetermined force is applied by a biasing spring.

* * * * *